US009437359B2

(12) United States Patent
Quintero Restrepo

(10) Patent No.: US 9,437,359 B2
(45) Date of Patent: Sep. 6, 2016

(54) REINFORCEMENT-FREE TANK FOR AN ELECTROMAGNETIC APPARATUS

(71) Applicant: SIEMENS AKTIENGESELLSCHAFT, Munich (DE)

(72) Inventor: William Fernando Quintero Restrepo, Bogota (CO)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 14/385,223

(22) PCT Filed: Mar. 11, 2013

(86) PCT No.: PCT/EP2013/054823

§ 371 (c)(1),
(2) Date: Sep. 15, 2014

(87) PCT Pub. No.: WO2013/135603

PCT Pub. Date: Sep. 19, 2013

(65) Prior Publication Data

US 2015/0091682 A1 Apr. 2, 2015

Related U.S. Application Data

(60) Provisional application No. 61/610,215, filed on Mar. 13, 2012.

(51) Int. Cl.
*H01F 27/02* (2006.01)
*H01F 27/10* (2006.01)

(52) U.S. Cl.
CPC ..... *H01F 27/025* (2013.01); *H01F 27/02* (2013.01)

(58) Field of Classification Search
CPC ..... H01F 27/025; H01F 27/02; H01F 27/10; H01F 27/12; H01F 27/125; H01F 27/14; H01F 27/16; H01F 27/18; H01F 27/26; H01F 27/263; H01F 27/266
USPC ..... 336/90, 94, 58, 57, 210
See application file for complete search history.

(56) References Cited

U.S. PATENT DOCUMENTS

| | | | | |
|---|---|---|---|---|
| 1,526,347 | A * | 2/1925 | Knotts | H01F 27/025 174/15.1 |
| 8,717,134 | B2 * | 5/2014 | Pintgen | H01F 27/14 174/17 LF |
| 2006/0201799 | A1 * | 9/2006 | Carrasco-Aguirre | 204/279 |

FOREIGN PATENT DOCUMENTS

| | | | |
|---|---|---|---|
| DE | 554718 C | | 7/1932 |
| GB | 2050069 | * | 4/1980 |
| JP | S5710911 A | | 1/1982 |
| JP | 58-053810 | * | 3/1983 |
| JP | 61-135104 A | * | 6/1986 |

* cited by examiner

*Primary Examiner* — Mangtin Lian
(74) *Attorney, Agent, or Firm* — Laurence Greenberg; Werner Stemer; Ralph Locher

(57) ABSTRACT

A reinforcement-free tank for an electromagnetic apparatus, as may be immersed in a fluid is provided. The tank may include a pair of mutually-opposite side walls. Each side wall may have at least one curved segment defining a vertically-curving profile between a top edge and a bottom edge of a side wall. A pair of mutually-opposite end walls. Each end wall may have a substantially vertically-extending semi-cylindrical shape defining a vertically-straight profile between a top edge and a bottom edge of an end wall. A plurality of vertically-extending joining members. Each joining member may be configured to provide a transition between the vertically-curving profile of a side wall and the vertically-straight profile of a corresponding end wall. The walls can withstand vacuum and overpressure conditions which can develop in the tank, without a reinforcing member connected to the walls.

20 Claims, 5 Drawing Sheets

REINFORCEMENT-FREE TANK FOR AN ELECTROMAGNETIC APPARATUS

This application claims benefit of the Mar. 13, 2012 filing date of U.S. provisional application 61/610,215, which is incorporated by reference herein.

FIELD OF THE INVENTION

This invention is generally related to an electromagnetic apparatus, such as a transformer, as may be immersed in a fluid in a tank, and, more particularly, but not exclusively, to a reinforcement-free tank, as may contain such an electromagnetic apparatus and fluid.

BACKGROUND OF THE INVENTION

Various electromagnetic apparatuses, such as transformers, autotransformers, reactors, may be immersed in a fluid (e.g., liquid and/or gaseous fluid) to ensure appropriate electrical isolation and/or cooling. Accordingly, such electrical apparatuses may utilize a tank structure to contain one or more of their active components immersed in the fluid.

It is known that such tanks may commonly involve the use of reinforcement structures (e.g., girders, etc.) as may be welded to walls of the tank for providing appropriate structural integrity so that the walls of the tank can appropriately withstand vacuum and overpressure conditions which can develop in the tank.

The use of such reinforcement structures, although effective to deal with such vacuum and overpressure conditions, tends to add to manufacturing complexity as well as to the physical weight and the monetary cost of such apparatuses. Moreover, the use of such reinforcement structures may reduce the available volumetric space for containing the active components immersed in the fluid. At least in view of the foregoing considerations, it would be desirable to provide an improved tank, as may reliably and cost-effectively meet applicable requirements without involving such reinforcement structures.

BRIEF DESCRIPTION OF THE DRAWINGS

The invention is explained in the following description in view of the drawings that show.

DETAILED DESCRIPTION OF THE INVENTION

Figure 1:
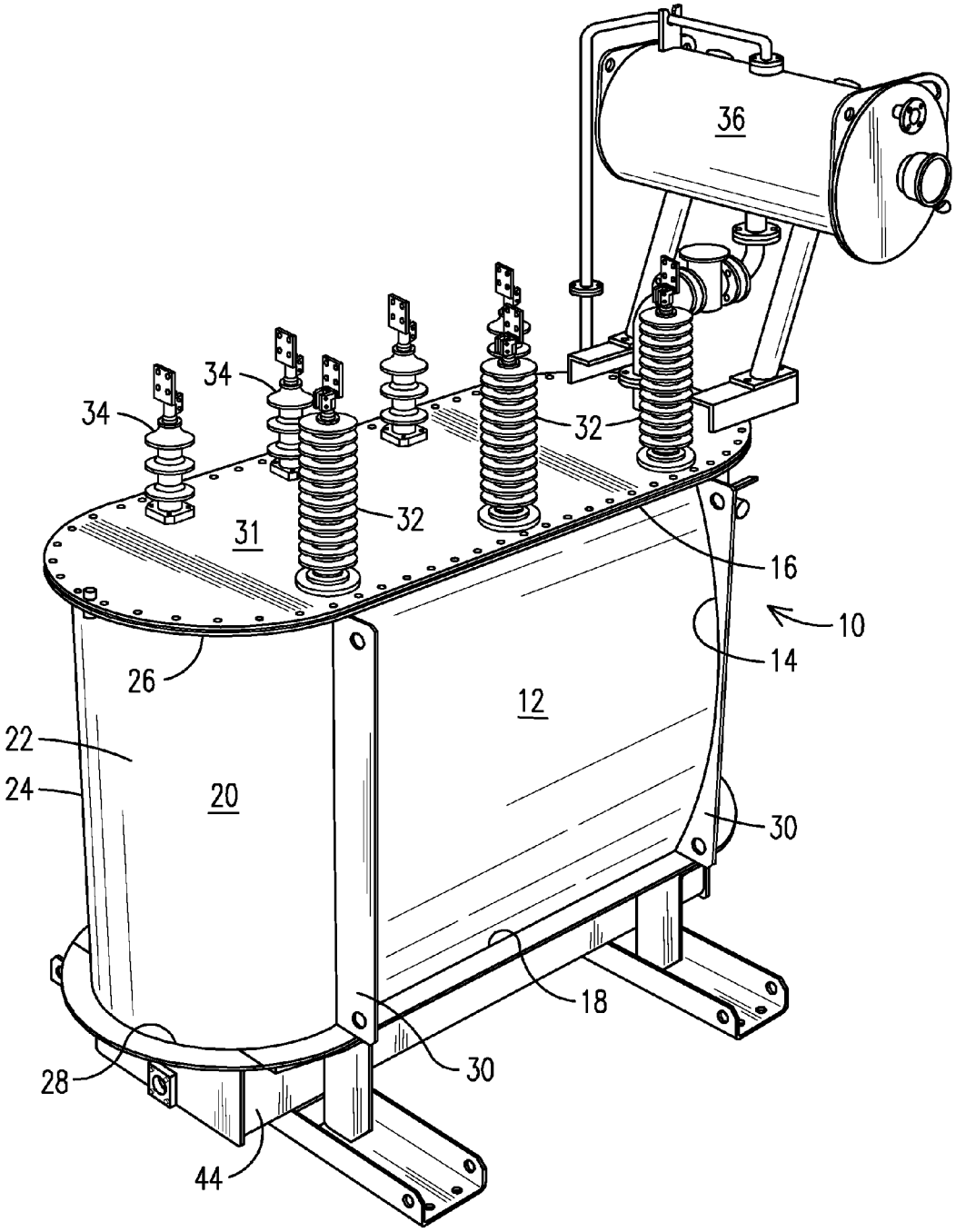
FIG. 1 is a first isometric view of an example electromagnetic apparatus including a reinforcement-free tank embodying aspects of the present invention.
Figure 2:
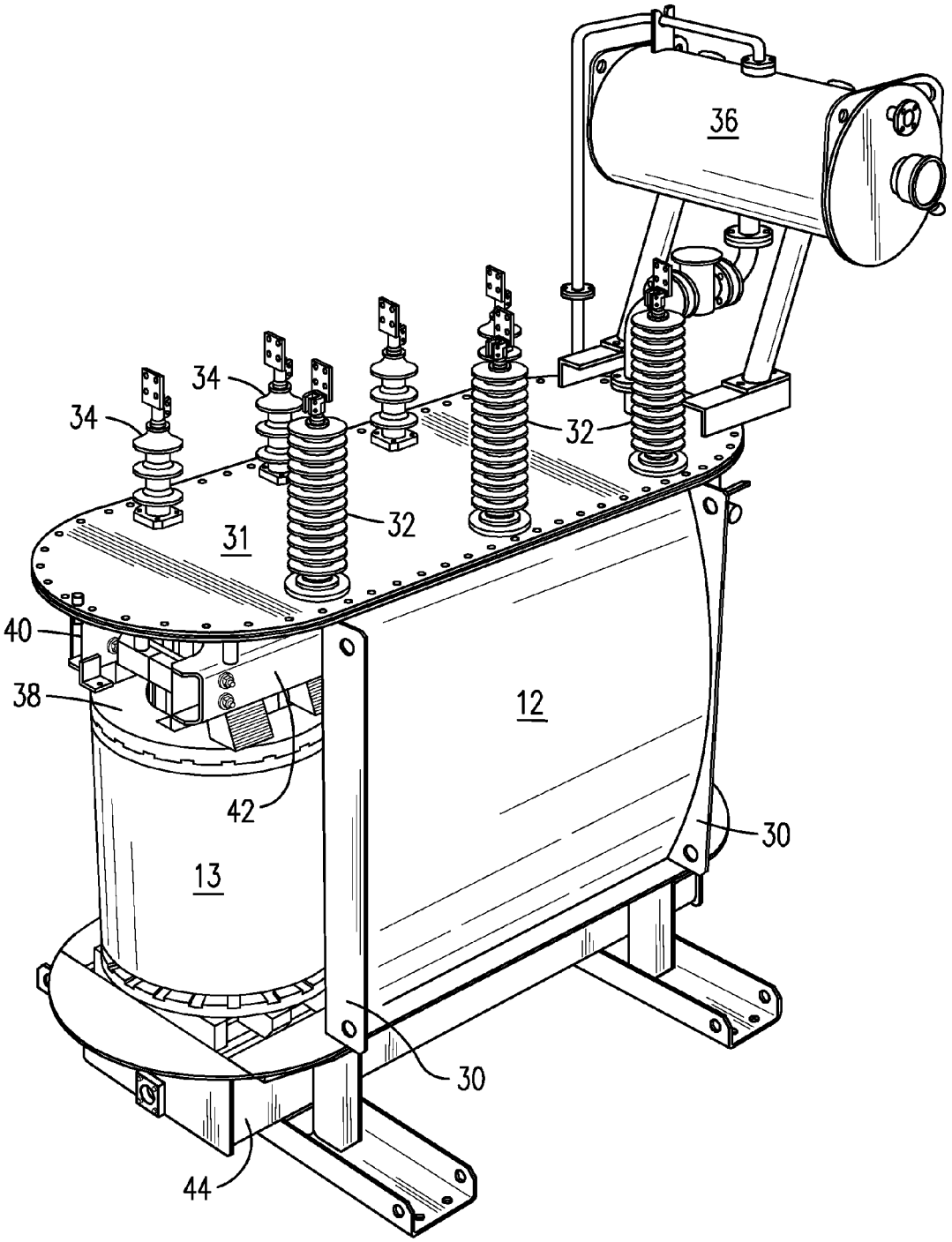
FIG. 2 is an isometric, partially cut-away view of the electromagnetic apparatus shown in FIG. 1.
Figure 3:
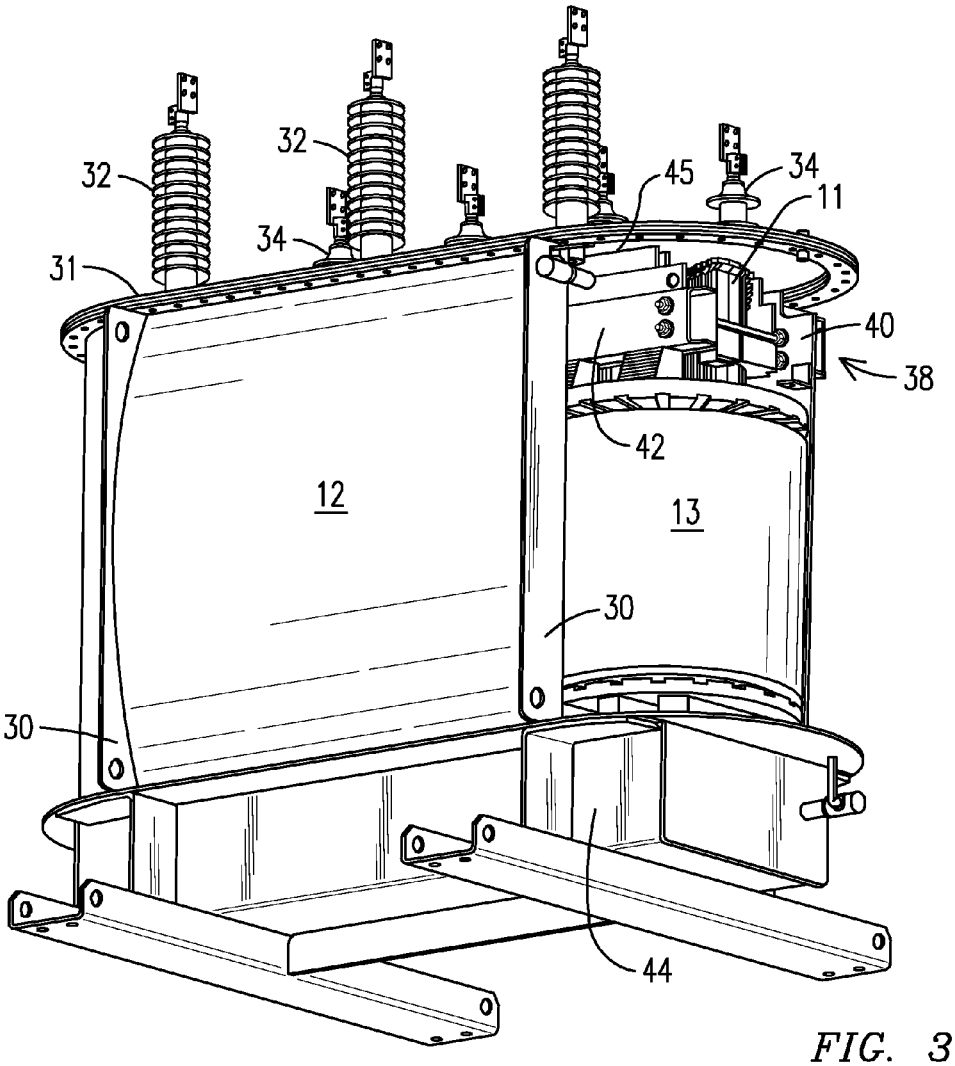
FIG. 3 is a second isometric view of an example electromagnetic apparatus including a reinforcement-free tank embodying aspects of the present invention.
Figure 5:
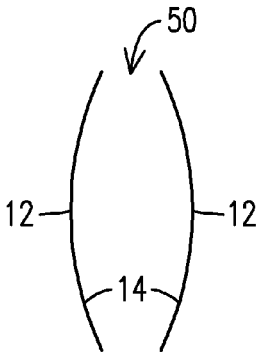
FIGS. 5-8 shows respective example embodiments of vertically-curving profiles of a side wall of a reinforcement-free tank embodying aspects of the present invention.
Figure 6:
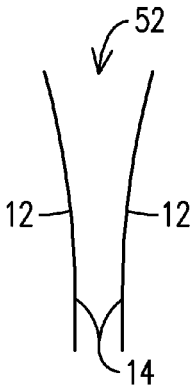
Figure 7:
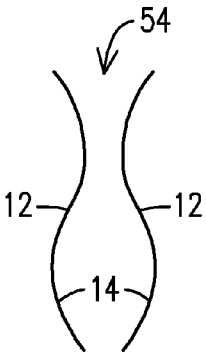
Figure 8:
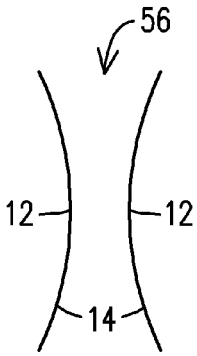

FIG. 1 is an isometric view of an example electromagnetic apparatus, as may include a reinforcement-free tank 10 embodying aspects of the present invention. In one example application, tank 10 may be used for accommodating one or more active components of the electromagnetic apparatus (e.g., transformer, autotransformer, reactor), which may be immersed in a fluid. Example active components which may be immersed in the fluid may be a core 11 (FIG. 4) and one or more windings 13, as may be appreciated in FIGS. 2-4 and 9.

In one example embodiment, tank 10 may include a pair of mutually-opposite side walls 12. FIG. 1 shows just one of side walls 12. Each side wall 12 may include at least one curved segment defining a vertically-curving profile 14 (an example embodiment may be better appreciated in FIG. 4) between a top edge 16 and a bottom edge 18 of a side wall 12.

Tank 10 may further include a pair of mutually-opposite end walls 20. FIG. 1 shows just one of end walls 20. Each end wall 20 may have a substantially vertically-extending semi-cylindrical shape 22 defining a vertically-straight profile 24 between a top edge 26 and a bottom edge 28 of an end wall 20.

Tank 10 may further include one or more vertically-extending joining members 30. Each joining member 30 may be configured to provide a transition between the vertically-curving profile 14 of a side wall 12 and the vertically-straight profile 24 of a corresponding end wall 20. In one example embodiment, the transition between the vertically-curving profile of a side wall 12 and the vertically-straight profile of a corresponding end wall 20 may be a welded joint. In accordance with aspects of the present invention, side walls 12 and end walls 20 can withstand vacuum and overpressure conditions which can develop in the tank without a reinforcing member connected to the walls.

In one example embodiment, tank 10 includes a top 31 for covering a top opening of the tank. FIG. 1 further illustrates example high-voltage bushings 32 and example low-voltage bushings 34, as may be used in a typical power transformer application. It will be appreciated that aspects of the present invention are not limited to the number and/or position of the example bushings illustrated in the figures. In one example embodiment, a standard conservator tank 36 may be used for allowing expansion and contraction of fluid in the tank, such as may occur due to temperature changes during operation of the transformer.

Figure 4:
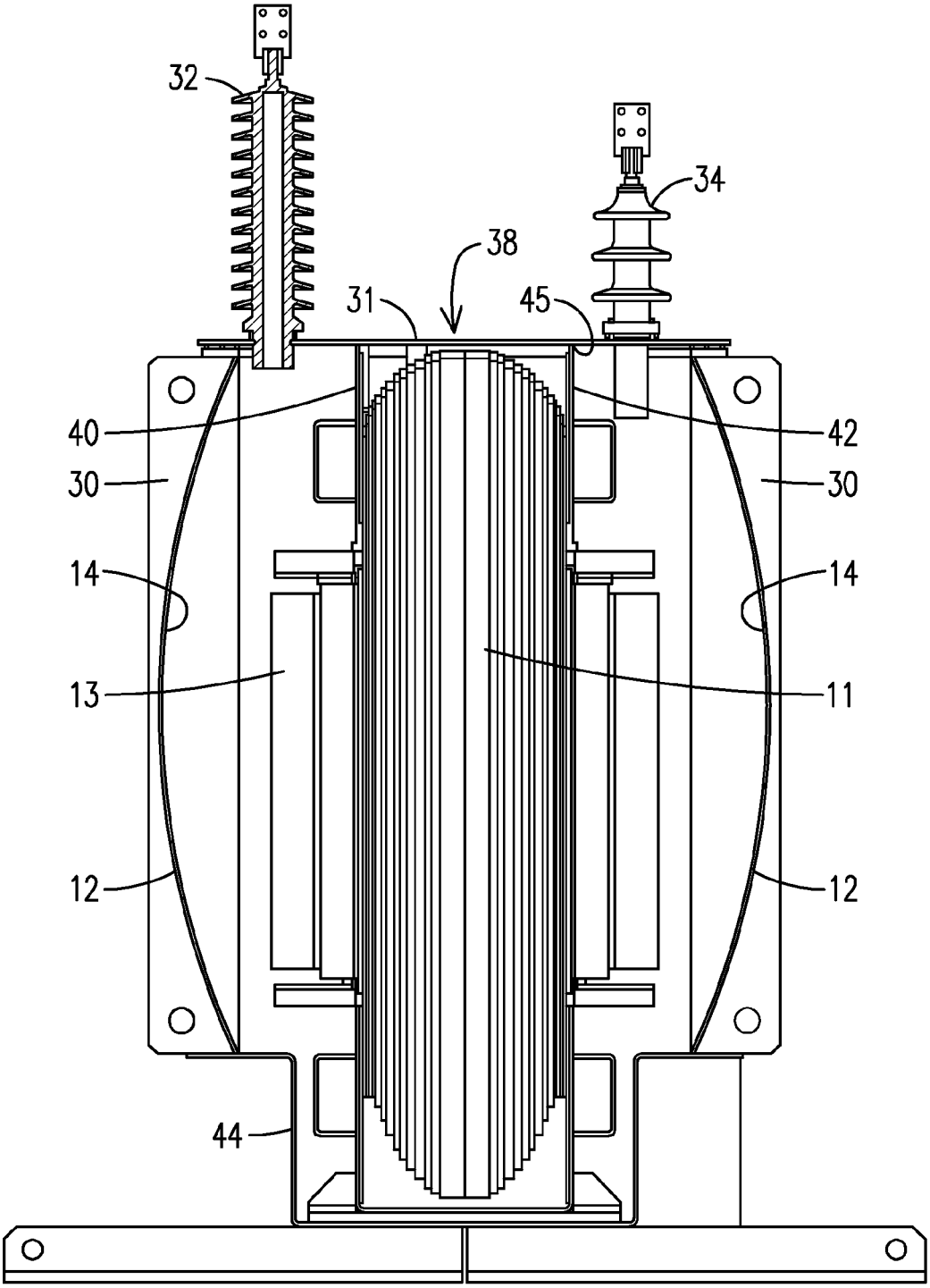
FIG. 4 is an end view of an example embodiment of a reinforcement-free tank embodying aspects of the present invention.
Figure 9:
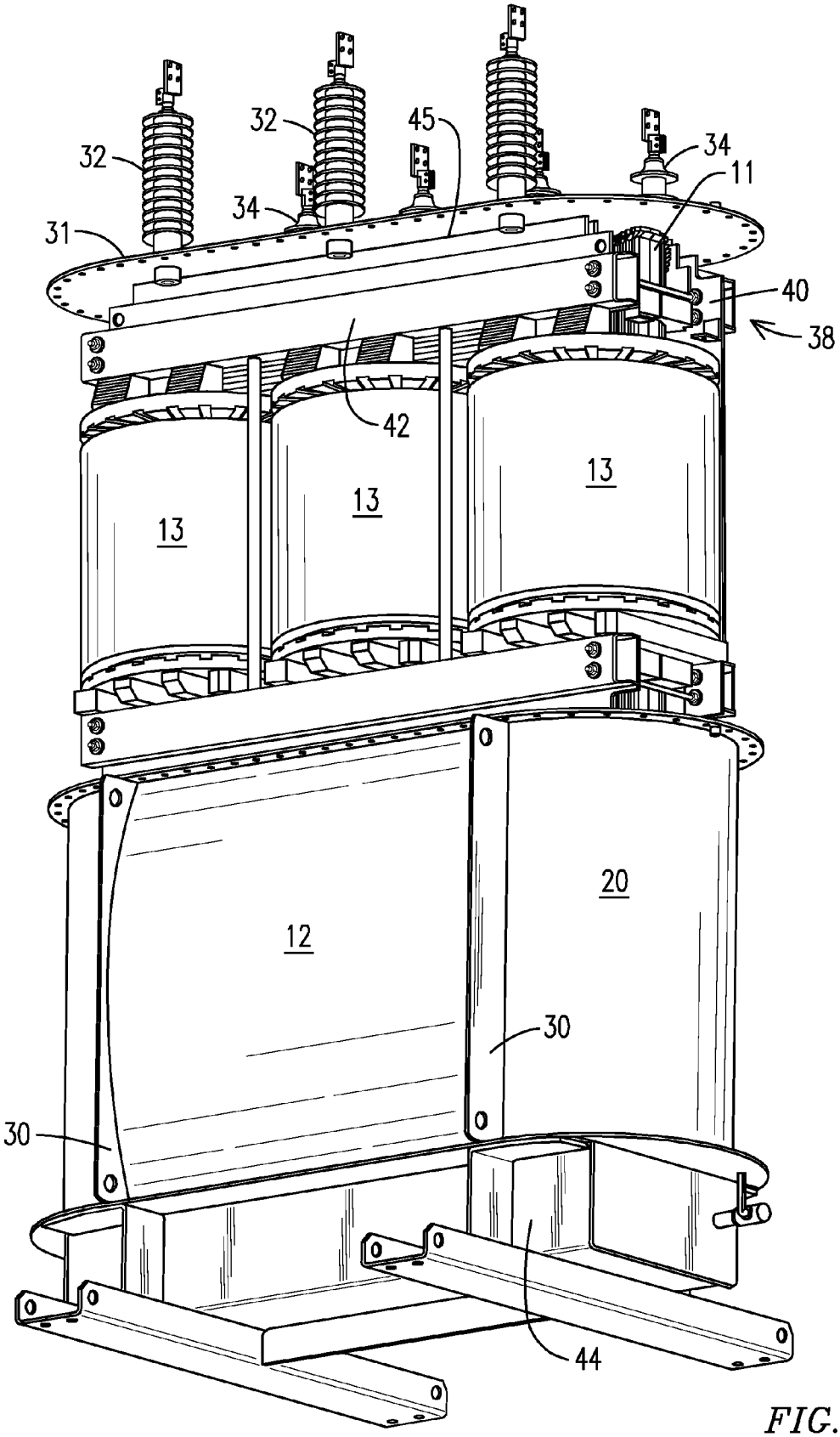
FIG. 9 is a third isometric exploded view of an example electromagnetic apparatus including a reinforcement-free tank embodying aspects of the present invention

As may be appreciated at least in FIGS. 4 and 9, a support structure 38, which in one example embodiment may comprise a pair of clamping members 40, 42, may provide a surface 45, which may be continually joined (e.g., by way of a load-carrying welded joint) along its length to a corresponding underside of top 31. Support structure 38 (e.g., by way of clamping members 40, 42) may be further arranged to support (e.g., by way of clamping) at least one component of the electromagnetic apparatus disposed inside the tank, such as core 11 and/or winding 13 so that such components remain securely assembled in place, notwithstanding forces that may develop during transportation, handling and operation of the transformer. In accordance with further aspects of the present invention, top 31 can withstand the vacuum and overpressure conditions which can develop in the tank without a further reinforcing member connected to the top.

A base 44 may be arranged to support one or more corresponding lower sections of the active components, such as core 11 and/or winding 13. In one example embodiment, base 44 may comprise a substantially "U" shaped cross-section and may be arranged to cover a bottom opening of the tank.

FIGS. 5-8 show respective example embodiments of vertically-curving profiles of side walls 12, as may be used in a reinforcement-free tank embodying aspects of the present invention. For example, in a first example embodiment, vertically-curving profile 14 may be a concave profile 50, such as curving outwardly toward its center between the top edge and the bottom edge of the side wall. In a second example embodiment, vertically-curving profile 14 may comprise a flaring profile 52, such as may expand outwardly between the bottom edge and the top edge of the side wall, or, alternatively, may contract inwardly between the bottom edge and the top edge of the side wall (for example, visualize flaring profile 52 being turned upside down). In a third example embodiment, vertically-curving profile 14 may be a serpentine profile 54, such as may include two or more curved segments. In a fourth example embodiment, vertically-curving profile 14 may be a convex profile 56 curving inwardly toward its center between the top edge and the bottom edge of the side wall. It will be appreciated that the foregoing examples of vertically-curving profiles should not be construed in a limiting sense being that other similar profiles will now be apparent to one skilled in the art.

Some example advantages of a tank embodying aspects of the invention may be:

- A relatively lesser number of parts (approximately a reduction of 30% or more relative to certain comparable conventional tank).
- A relatively lesser amount of weight (approximately a reduction of 40% or more relative to certain comparable conventional tank).
- A relatively lesser manufacturing complexity (approximately savings of 40% or more relative to the manufacturing costs of certain comparable conventional tank).
- A relatively more compact structure relative to certain comparable conventional tank.

Example applications of a tank embodying aspects of the invention may be transformers involving any of various cooling methodologies, such as "Oil Natural Air Natural" (ONAN), "Oil Natural Air Forced" (ONAF), "Oil Forced Air Forced" (OFAF), "Oil Forced Water Forced" OFWF transformers, any liquid-immersed transformer, transformers in mobile substations, etc.

While various embodiments of the present invention have been shown and described herein, it will be apparent that such embodiments are provided by way of example only. Numerous variations, changes and substitutions may be made without departing from the invention herein. Accordingly, it is intended that the invention be limited only by the spirit and scope of the appended claims.

The invention claimed is:

1. A reinforcement-free tank for an electromagnetic apparatus immersed in a fluid, the tank comprising:

a pair of mutually-opposite side walls, each of said side walls having at least one curved segment defining a vertically-curving and horizontally straight profile between a top edge and a bottom edge of a side wall;

a pair of mutually-opposite end walls, each of said end walls having a substantially vertically-extending semi-cylindrical shape defining a vertically-straight profile between a top edge and a bottom edge of an end wall; and vertically-extending joining members, each of said joining members being configured to provide a transition between the vertically-curving profile of a side wall and the vertically-straight profile of a corresponding end wall, wherein the walls can withstand vacuum and/or overpressure conditions which can develop in the tank without a reinforcing member connected to the walls.

2. The tank of claim 1, further comprising a top for covering a top opening of the tank.

3. The tank of claim 2, further comprising a support structure having a surface continually joined along a length thereof to an underside of the top, the support structure further arranged to support at least one component of the electromagnetic apparatus disposed inside the tank, wherein the top can withstand the vacuum and/or overpressure conditions which can develop in the tank without a further reinforcing member connected to the top.

4. The tank of claim 2, further comprising a base having a substantially "U" shaped cross-section, the base arranged to cover a bottom opening of the tank.

5. The tank of claim 1, wherein the vertically-curving profile comprises a concave profile curving outwardly toward a center thereof between the top edge and the bottom edge of the side wall.

6. The tank of claim 1, wherein the vertically-curving profile comprises a convex profile curving inwardly toward a center thereof between the top edge and the bottom edge of the side wall.

7. The tank of claim 1, wherein the vertically-curving profile comprises a flaring profile between the top edge and the bottom edge of the side wall.

8. The tank of claim 1, wherein the vertically-curving profile comprises a serpentine profile comprising at least two curved segments between the top edge and the bottom edge of the side wall.

9. The tank of claim 1, wherein said at least one component of the electromagnetic apparatus disposed inside the tank comprises a core and at least one winding.

10. The tank of claim 1, wherein the transition between the vertically-curving profile of a side wall and the vertically-straight profile of a corresponding end wall comprises a welded joint.

11. The tank of claim 3, wherein the support structure is continually joined along a length thereof to the underside of the top by way of a load-carrying welded joint.

12. The tank of claim 1, wherein the electromagnetic apparatus comprises an apparatus selected from the group consisting of a transformer, an autotransformer and a reactor.

13. A transformer comprising the tank of claim 1.

14. A tank for an electromagnetic apparatus having at least one component immersed in a fluid, the tank comprising:

a pair of mutually-opposite side walls and a pair of mutually-opposite end walls, each end wall having a substantially vertically-extending semi-cylindrical shape defining a vertically-straight profile between a top edge and a bottom edge of an end wall, each side wall having at least one curved segment defining a vertically-curving and horizontally straight profile between a top edge and a bottom edge of a side wall, and vertically-extending joining members each configured to provide a transition between the vertically-curving profile of a side wall and the vertically-straight profile of a corresponding end wall, wherein the walls can withstand vacuum and/or overpressure conditions which can develop in the tank without a reinforcing member connected to the walls.

15. The tank of claim 14, further comprising a top for covering a top opening of the tank, a support structure including a surface continually joined along a length thereof to an underside of the top, the support structure further arranged to support at least one component of the electromagnetic apparatus disposed inside the tank, wherein the top can withstand the vacuum and/or overpressure conditions which can develop in the tank without a further reinforcing member connected to the top.

16. The tank of claim 14, wherein the vertically-curving profile comprises a profile selected from the group consisting of a concave profile curving outwardly toward a center thereof between the top edge and the bottom edge of the side wall, a convex profile curving inwardly toward a center thereof between the top edge and the bottom edge of the side wall, a flaring profile between the top edge and the bottom edge of the side wall, and a serpentine profile comprising at least two curved segments between the top edge and the bottom edge of the side wall.

17. An electromagnetic apparatus comprising:

a reinforcement-free tank to accommodate a core of a transformer and at least one winding of the transformer immersed in a fluid, the tank comprising:

a pair of mutually-opposite side walls, each of said side walls having at least one curved segment defining a vertically-curving and horizontally-straight profile between a top edge and a bottom edge of a side wall;

a pair of mutually-opposite end walls, each of said end walls having a substantially vertically-extending semi-cylindrical shape defining a vertically-straight profile between a top edge and a bottom edge of an end wall;

vertically-extending joining members, each of said joining members being configured to provide a transition between the vertically-curving profile of a side wall and the vertically-straight profile of a corresponding end wall, wherein the walls can withstand vacuum and/or overpressure conditions which can develop in the tank without a reinforcing member connected to the walls;

a top for covering a top opening of the tank; and a support structure including a surface continually joined along a length thereof to an underside of the top, the support structure further arranged to support at least one component of the electromagnetic apparatus disposed inside the tank, wherein the walls and the top are formed to withstand the vacuum and/or overpressure conditions without further reinforcing members connected to the top.

18. The electromagnetic apparatus of claim 17, wherein the vertically-curving profile comprises a profile selected from the group consisting of a concave profile curving outwardly toward a center thereof between the top edge and the bottom edge of the side wall, a convex profile curving inwardly toward a center thereof between the top edge and the bottom edge of the side wall, a flaring profile between the top edge and the bottom edge of the side wall, and a serpentine profile comprising at least two curved segments between the top edge and the bottom edge of the side wall.

19. The electromagnetic apparatus of claim 17, wherein the support structure is continually joined along a length thereof to the underside of the top by way of a load-carrying welded joint.

20. The electromagnetic apparatus of claim 17, wherein the electromagnetic apparatus comprises an apparatus selected from the group consisting of a transformer, an autotransformer and a reactor.

* * * * *